United States Patent [19]

Waldbrook

[11] 3,951,487

[45] Apr. 20, 1976

[54] ELECTRICAL RECEPTACLE PLUG AND SOCKET

[75] Inventor: Gerald A. Waldbrook, Capreol, Canada

[73] Assignee: The Raymond Lee Organization, Inc., New York, N.Y.

[22] Filed: Dec. 16, 1974

[21] Appl. No.: 532,951

[52] U.S. Cl. ..... 339/8 R; 339/153; 339/191 R

[51] Int. Cl.[2] ..... H01R 39/00

[58] Field of Search ..... 339/8 R, 8 A, 34, 6 R, 339/6 A, 153, 154, 195 R, 191 R, 191 M

[56] References Cited

UNITED STATES PATENTS

| | | | |
|---|---|---|---|
| 3,092,695 | 6/1963 | Abrams | 339/6 A X |
| 3,321,729 | 5/1967 | Phillips | 339/8 R |
| 3,437,976 | 4/1969 | Nelson | 339/8 R |

*Primary Examiner*—Roy Lake
*Assistant Examiner*—DeWalden W. Jones
*Attorney, Agent, or Firm*—Howard I. Podell

[57] ABSTRACT

A device for attachment to a conventional wall electrical socket receptacle which is fitted with an electrical socket for purposes of relocating the attachment location of any portable electrical line cord to the wall socket. The device incorporates a male electrical plug rotatably mounted to an arm member, the other end of which is fitted with an electrical female socket, with each male contact of the plug connected electrically to an appropriate female contact of the socket. The rotatable joint of the device is fitted with releasable latching means to hold the female socket in a desired orientation to the male plug, when the plug is attached to a fixed female wall electrical receptacle.

2 Claims, 6 Drawing Figures

ELECTRICAL RECEPTACLE PLUG AND SOCKET

SUMMARY OF THE INVENTION

My invention is a device for attachment to a conventional wall electrical socket receptacle which is fitted with an electrical socket for purposes of relocating the attachment location of any portable electrical line cord to the wall socket.

The device incorporates a male electrical plug rotatably mounted to an arm member, the other end of which is fitted with an electrical female socket, with each male contact of the plug connected electrically to an appropriate female contact of the socket.

The rotatable joint of the device is fitted with releasable latching means to hold the female socket in a desired orientation to the mele plug, when the plug is attached to a fixed female wall electrical receptacle.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
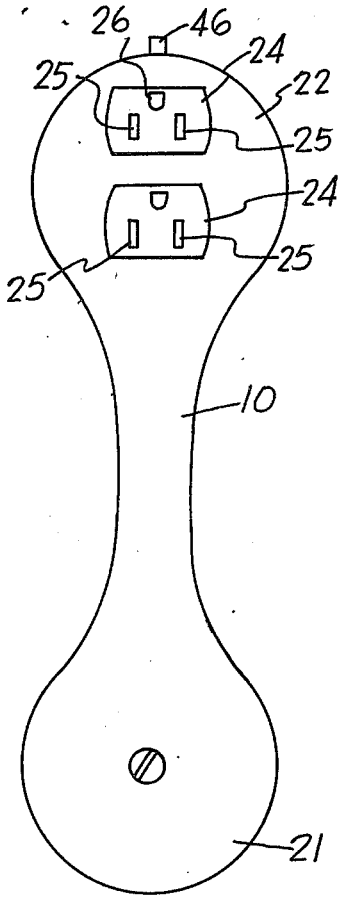
FIG. 1 is a front elevation front view of the invention.

Turning now descriptively to the drawings, in which similar reference characters denote similar elements throughout the several views, FIGS. 1–6 illustrate the invention 10, one end 21 of which is fitted with two sets of male prongs 35 and 36 for fitting in the pair of female contacts of a conventional wall socket (not shown) and the other end 22 of which is fitted with one or more conventional female sockets 24 to which flexible electrical cords may be conventionally attached.

The female contacts 25 and female ground contact 26 of the sockets 24 are connected individually by internal wires 31 to the two male contact prongs 35 and ground prong 36 of each of the sets of prongs of the plug section 37.

Plug section 37 is rotatably mounted in the end 21 of the device, with each pair of contact prongs 35 and the pair of ground prongs 36 individually joined to a separate concentric circular contact strip 38 on the internal surface of the plug, with each wire 31 mounted to a spring contact 17 in the inside section of end 21 so as to electrically contact one strip 38, while permitting free rotation of plug section 37 with regard to end 21.

The circular rim 18 of plug section 37 is flanged with the interior surface of the rim 18 being formed with gear teeth 16 that mesh with a stop member 29 joined to a slidable rod 28 mounted inside of the device and projecting at the socket end 22 as a push button 46. Manual movement of button 46 acts to free rim 18 of engagement with stop member 29 to permit rotation of plug section 37.

Figure 2:
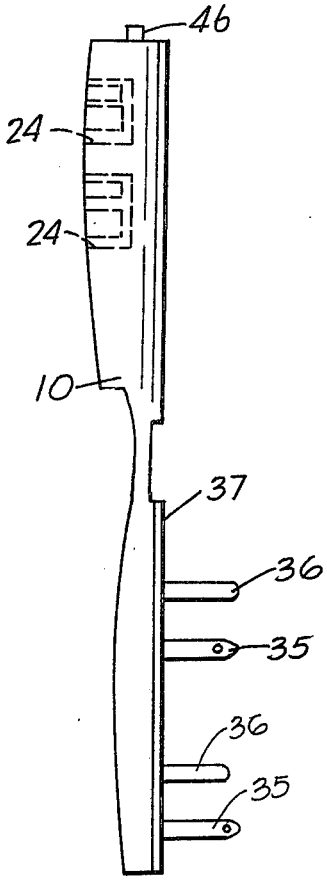
FIG. 2 is a side view of the invention.
Figure 3:
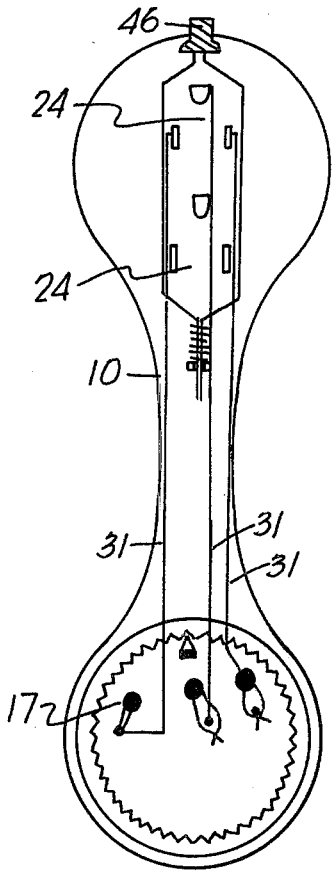
FIG. 3 is a rear elevation view of the invention.
Figure 5:
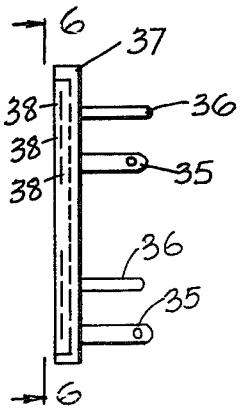
FIG. 5 is an end view of the plug of the invention.
Figure 6:
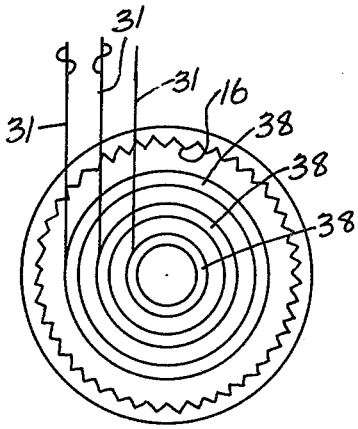
FIG. 6 is a front view of the plug of the invention, taken along line 6—6 of FIG. 5.
Figure 4:
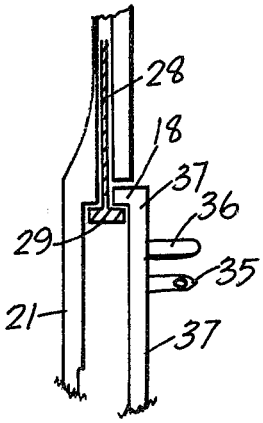
FIG. 4 is a fragmentary sectional view of the plug end of the device.

As shown in FIGS. 1–2, the prongs 35 and 36 of the plug section 37 are mounted on the opposite face of the device 10 from the socket springs of the female contacts 25 and 26 so that prongs 35 and 36 may fit into the openings of a wall-mounted receptacle, with socket openings of the female contacts 25 and 26 being on the external face of the device to permit ready attachment of a portable cord plug at a distance from the attached wall-mounted receptacle.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A device, attachable to an electrical wall-mounted socket which contains a female socket for electrically connecting the plug of a portable electrical line cord to the electrical supply at a distance from the wall-mounted socket, comprising a member fitted at one end with a female electrical socket and at the other end with a male electrical plug, with the contacts of the socket individually joined electrically to corresponding contacts of the plug, with the contact pins of the plug mounted to a disc which is rotatably fitted in an end of the device, in which latching means are joined to an external push button to maintain the disc in non-rotatable engagement with the device.

2. The combination as recited in claim 1 in which the latching means are mounted so as to free the disc to permit the disc to rotate relative to the device when the external push-button is manually depressed.

* * * * *